US006790067B2

(12) United States Patent
Douty et al.

(10) Patent No.: US 6,790,067 B2
(45) Date of Patent: Sep. 14, 2004

(54) FINGER PROOF POWER CONNECTOR

(75) Inventors: George H. Douty, Mifflintown, PA (US); Richard P. Walter, Elizabethtown, PA (US); Ronald M. Weber, Annville, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/322,065

(22) Filed: Dec. 17, 2002

(65) Prior Publication Data

US 2004/0115980 A1 Jun. 17, 2004

(51) Int. Cl.[7] ..... H01R 13/28

(52) U.S. Cl. ..... 439/284; 439/285; 439/680; 439/681; 439/682; 439/683; 439/595; 439/603

(58) Field of Search ..... 439/285, 680, 439/681–683, 595, 603, 284

(56) References Cited

U.S. PATENT DOCUMENTS

| | | | | | |
|---|---|---|---|---|---|
| 3,654,586 | A | * | 4/1972 | Winkler | 439/295 |
| 4,405,192 | A | * | 9/1983 | Eaby et al. | 439/358 |
| 4,764,129 | A | * | 8/1988 | Jones et al. | 439/677 |
| 4,946,399 | A | * | 8/1990 | Kawashima | 439/752 |
| 4,990,099 | A | * | 2/1991 | Marin et al. | 439/284 |
| 5,308,258 | A | * | 5/1994 | Hatsios | 439/284 |
| 5,575,674 | A | * | 11/1996 | Davis et al. | 439/284 |

OTHER PUBLICATIONS

"SBE 80 Housing and Spring Assembly Outline Drawing", Anderson Power Products, Mar. 16, 1999.

* cited by examiner

*Primary Examiner*—Truc Nguyen

(57) ABSTRACT

A hermaphroditic connector is provided having a housing with a rear end configured to receive a cable. A socket is provided on the front end of the housing and extends forwardly therefrom. The socket includes a shroud and a socket tongue formed on the housing and defining a pocket opening onto a front face of the socket. The shroud and socket tongue are configured to mate with another hermaphroditic connector having a similar shape. The socket includes at least one blocking member in the opening in the front face to interfere with foreign objects that may inadvertently come into contact with the enclosed conductive member. The blocking member may include ribs and/or beveled corner inserts provided in the pocket and extending at least partially along the length of the socket. A contact is held within the pocket and is configured to join a power, signal or ground cable. The bottom surface of the socket includes one or more grooves and/or chamfered edges configured to align with ribs and/or beveled corner cutouts on a mating connector. In accordance with at least one embodiment, the socket includes a shroud and a socket tongue that are staggered with the length of the shroud being greater than the length of the socket tongue in order to exclude foreign objects without interfering with mating of connectors.

23 Claims, 5 Drawing Sheets

FINGER PROOF POWER CONNECTOR

BACKGROUND OF THE INVENTION

The present invention generally relates to a power connector configured to block foreign objects from being inserted into the mating area of the connector.

In the past, genderless or hermaphroditic power connectors have been proposed, wherein mating connector halves have a common shape, yet are matable with one another. To mate genderless connector halves, they are simply inverted 180 degrees with respect to one another before being joined. Exemplary genderless connectors are shown in FIG. 1 at reference numerals 10 and 12. The connectors 10, 12 receive a pair of cables 18 and 18' in the rear ends, respectively. Connecting ends 14 and 14' are formed to define a lower pocket portion including close ended cable terminal receiving pockets 20, 20' and 22, 22' and an upper socket portion including open ended inverted U-shaped sockets 24, 24' and 26, 26'. The sockets 24, 24' and 26, 26' are adapted to snugly receive pockets 20', 20 and 22', 22, respectively. Central partition walls 28, 28' extend from the periphery of the connectors 10, 12 to define and separate the sockets 24, 24' and 26, 26'. A complimentary slot 30, 30' is formed between the pockets 20, 20' and 22, 22'. The slot 30, 30' receives the central wall 28, 28' when connectors 10, 12 are longitudinally engaged with one another.

Conventional hermaphroditic power connectors have also been proposed with keying ribs and strengthening ribs formed in the sockets 24, 24' and 26, 26' and/or on the outside of the pockets 20, 20' and 22, 22'. The keying ribs ensure that only connectors of similar power and intended for similar applications are joined with one another. The strengthening ribs add support to the sockets 24, 24' and 26, 26'.

However, conventional genderless power connectors have experienced certain limitations. In particular, the open sockets 24, 24' and 26, 26' permit foreign objects, such as a finger, tools and the like, to be inserted. The foreign objects may contact the cable terminals 16 which may in turn deliver a high current or high voltage shock to a person or create a large arc with a metallic foreign object.

A need remains for an improved genderless or hermaphroditic connector that prevents foreign objects from being inserted into open sockets of the connector.

BRIEF SUMMARY OF THE INVENTION

A hermaphroditic connector is provided having a housing with a rear end configured to receive a cable. A socket is provided on the front end of the housing and extends forwardly from the housing. The socket includes a shroud and a socket tongue formed separate or integral with one another. The connector includes a pocket that opens onto a front face of the socket. The shroud and socket tongue are configured to mate with another hermaphroditic or genderless connector having a similar shape. The socket includes at least one blocking member, such as a beveled corner insert or rib extending at least partially along a length of an interior surface of the pocket. The blocking member interferes with foreign objects that may inadvertently come into contact with the open face of the socket. A contact is held within the pocket and is configured to join a power, signal or ground cable. The socket tongue includes one or more grooves or chamfers configured to interpose with respective ribs or beveled corner inserts on a mating connector.

In accordance with at least one embodiment, the length of the shroud is greater than the length of the socket tongue in order that the front face of the shroud projects beyond a lead end of the socket tongue to exclude foreign objects without interfering with mating of connectors.

Figure 1:
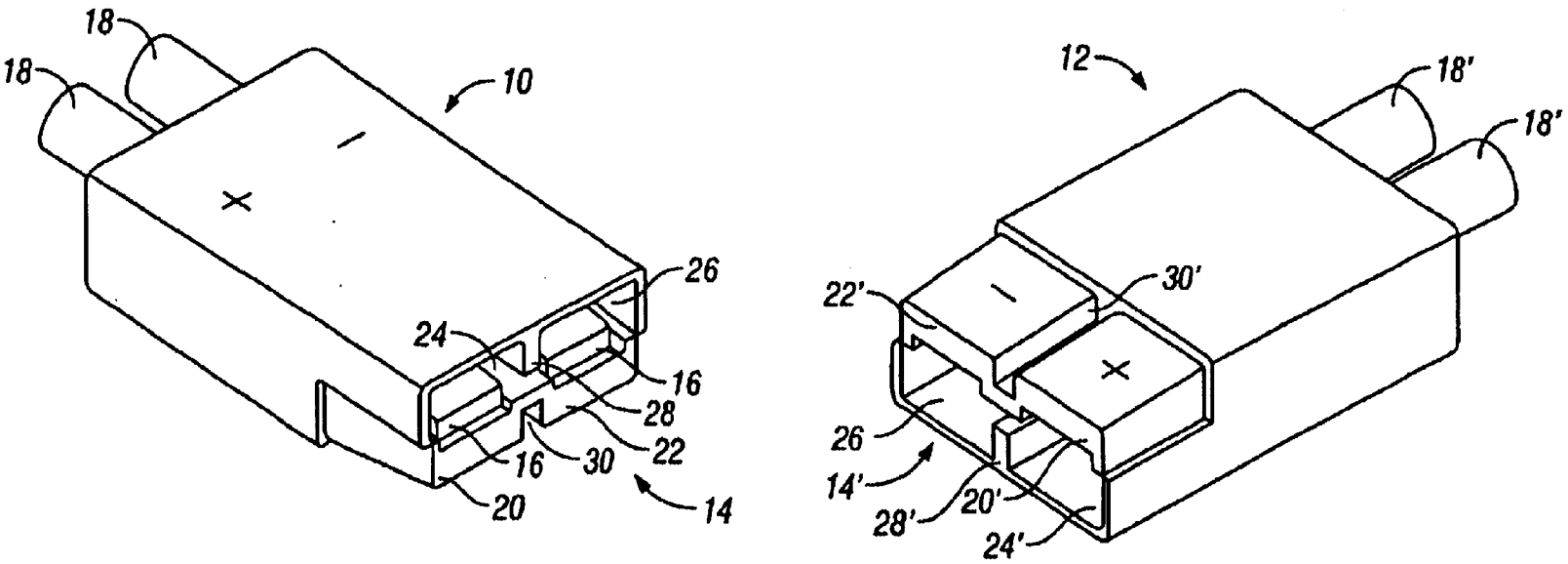
FIG. 1 Prior Art
FIG. 1 illustrates a conventional genderless power connector.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

Figure 2:
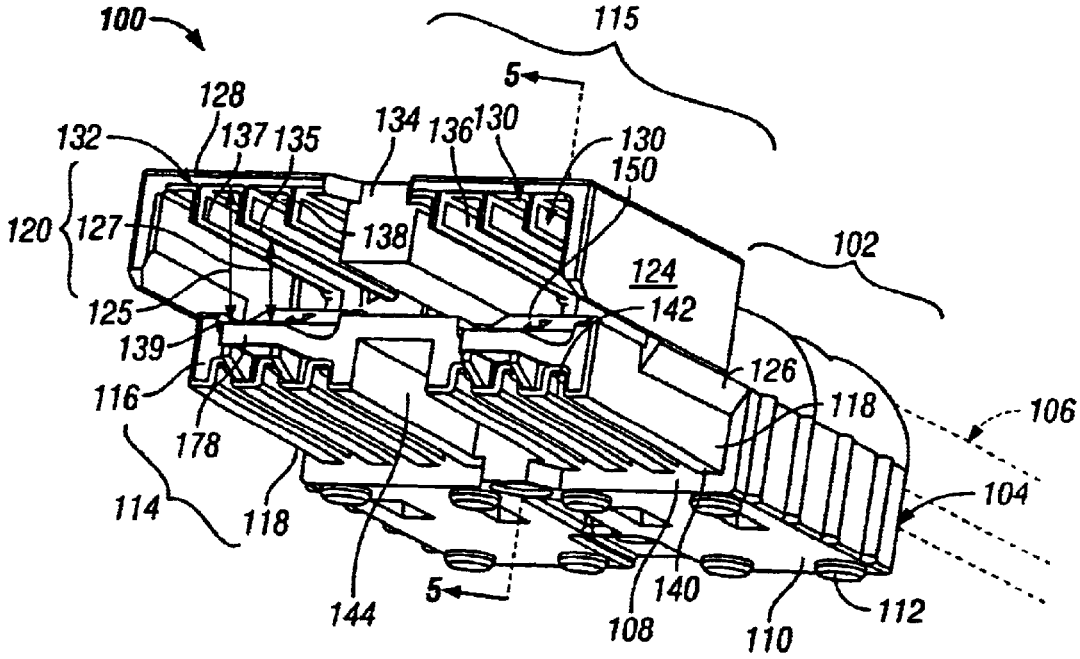
FIG. 2 illustrates an isometric view of a genderless connector formed in accordance with an embodiment of the present invention.

FIG. 2 illustrates a genderless or hermaphroditic connector 100 formed in accordance with an embodiment of the present invention. The connector 100 includes a body portion 102 with a rear end 104 configured to receive contacts 150 terminated to power cables (denoted in dashed lines 106). A front end 108 of the body portion 102 joins a socket 115 that includes a shroud 120 and a socket tongue 114. The body portion 102 includes a bottom surface 110 configured to be mounted to a board or chassis, such as with a bolt and nut. The bottom surface 110 includes standoffs 112 configured to space the connector 100 above the structure to which the connector 100 is mounted. Standoffs 112 maintain a desired spacing between the structure, to which the connector 100 is mounted, and the socket tongue 114 to permit joining with a mating connector 100.

The socket tongue 114 extends, forward from the front end 108 by a predetermined distance and terminates at lead end 116. The socket tongue 114 includes side surfaces 118. The shroud 120 includes sidewalls 124 that are molded integrally with the socket tongue 114 at support segments 126. Optionally, support segments 126 may be removed entirely such that the shroud 120 and socket tongue 114 are completely spaced apart from one another and are separately suspended from the body portion 102. A top wall 128 of the shroud 120 extends between the sidewalls 124 to enclose pockets 130. While two pockets 130 are shown, optionally a single pocket or more than two pockets 130 may be provided depending upon the number of cables 106 to be accommodated. The pockets 130 open onto a front face 132 of the shroud 120 which mates with a corresponding socket tongue 114 on a mating (inverted) hermaphroditic connector 100. The thickness of the top wall 128 can be varied to strengthen the shroud 120 to prevent bowing of the top wall 128. The height of the standoffs 112 can be varied depending upon the thickness of the top wall 128 to space connector 100 off of a mounting surface and accommodate an increased thickness of top wall 128.

The shroud 120 includes a central partition wall 134 extending parallel to the sidewalls 124 and dividing the shroud 120 into pockets 130 aligned side by side and in alignment with separate power cables 106. The shroud 120 further includes ribs 136 provided in the pockets 130. The ribs 136 extend parallel to one another from the front face 132 into the pockets 130 along at least a portion of the length of the connector 100. The ribs 136 project downward from the bottom surface 138 of the top wall 128.

The socket tongue 114 includes a bottom surface 140 having grooves 142 extending parallel to one another and extending rearward from the lead end 116 of the socket tongue 114. The grooves 142 and ribs 136 are configured to interpose with one another when the socket tongues 114 on one connector 100 are joined within corresponding pockets 130 on an inverted mating connector 100. The grooves 142 extend to the front end 108 of the body portion 102, in order that, when mating connectors 100 are joined, the front faces 132 abut against front ends 108. The ribs 136 reduce an overall interior envelope of each pocket 130 formed by interior surfaces of the top wall 128, side walls 124 and socket tongue 114. The overall dimensions of the interior envelope are somewhat dependent on the power conveying capacity of the connector 100. More specifically, as the power capacity increases, the cable size and contact size similarly increase. As the size of the contact 150 increases, the interior envelope of each pocket 130 also increases. Ribs 136 enable the functional interior envelope of each pocket 130 to remain large, while the unobstructed height 127 is reduced. This prevents large foreign objects from being easily inserted into the pockets 130.

The pockets 130 have a height 125 extending from the bottom surface 138 of the top wall 128 to the top surface 139 of the socket tongue 114. The ribs 136 extend downward from the top wall 128 by a height 137 into the pockets 130. The ribs 136 have bottom edges 135 that are spaced a height 127 above the top surface 139 of the socket tongue 114. The height 127 represents a height of an unobstructed portion of the pocket 130.

The height 137 of ribs 136 is at least approximately one-fourth (and may be one-third) of the height 125 of the pocket 130, thereby leaving the height 127 of the unobstructed portion to be approximately three-fourths or two-thirds of the height 125 of the pocket 130. Optionally, the height 137 of the ribs 136 may be extended further down into the pocket 130, such as to equal one-half of the height 125. If extended in this manner, the height 127 of the unobstructed portion would only be one-half of the height 125 of the pocket 130.

By way of example only, the height 125 of the pocket 130 may be approximately 9 mm, while the height 137 of the ribs 136 may be approximately 2 mm and the height 127 of the unobstructed portion may be approximately 7 mm.

The socket tongue 114 also includes a central channel 144 cut therein and configured to align with the central partition wall 134 on a mating connector 100. The central partition wall 134 and central channel 144 may be used as a keying feature, wherein connectors 100 used in varying applications within a common system are provided with different sized or configured central partition walls 134 and central channels 144.

Figure 3:
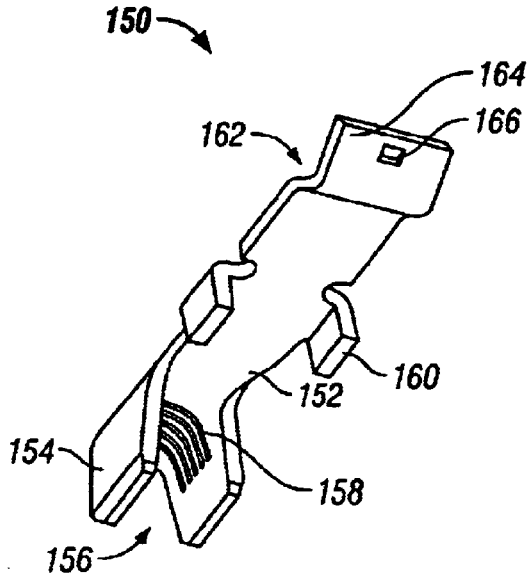
FIG. 3 illustrates a bottom isometric view of a contact held within a genderless connector formed in accordance with an embodiment of the present invention.
Figure 4:
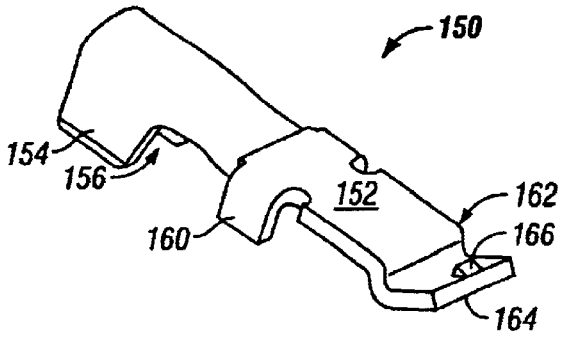
FIG. 4 illustrates a top isometric view of the contact of FIG. 3.
Figure 5:
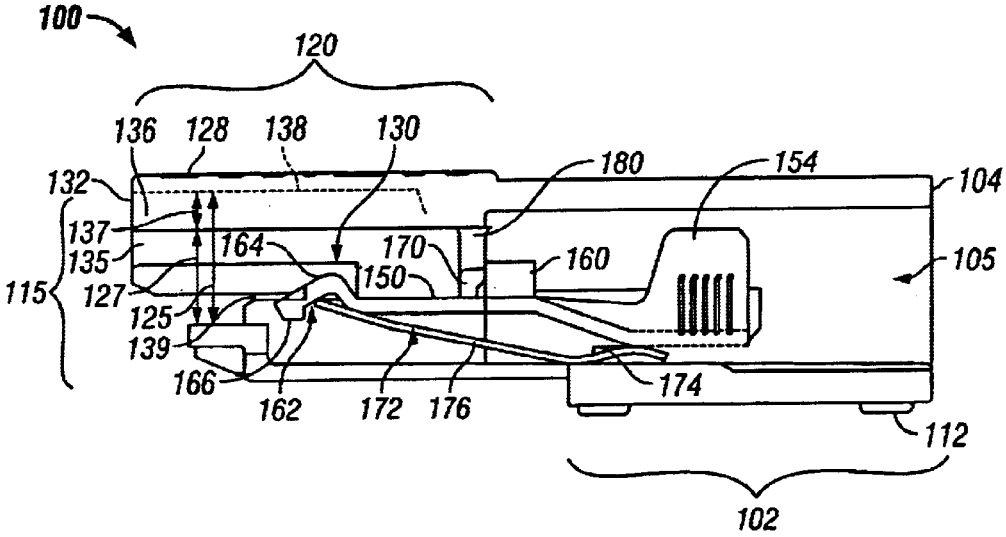
FIG. 5 illustrates a side sectional view of the connector of FIG. 2 taken along line 5—5.

FIGS. 3 and 4 illustrate an exemplary contact 150 that may be attached to a power cable 106 and inserted into the connector 100. The contact 150 includes a main body 152 extending along the length of the contact 150. The main body 152 includes at its rear end a crimp barrel 154 of open or closed design. A power, signal or ground cable may be inserted into a gap 156 in the crimp barrel 154 which is then folded to frictionally grip the cable. Optionally, the crimp barrel 154 and main body 152 may be formed with cable gripping features 158 such as ribs or recessed grooves cut laterally across the contact 150 to facilitate gripping of the cable. The main body 152 also includes a pair of wings 160 located along the sides at an intermediate point along the length of the contact 150. The wings 160 extend upward from the main body 152 and are positioned to engage a corresponding feature (discussed below) within the connector 100 to prevent the contact 150 from being inadvertently loaded too far forward into the connector 100. The lead end of the main body 152 of the contact 150 is bent to form a hook portion 162 and to provide a contact surface 164 beyond the hook portion 162. Contact surfaces 164 on joining contacts 150 mate with one another. The hook portion 162 engages a mating feature (explained below) within the connector 100 to resist removal of the contact 150 from the rear end 104 of the connector 100:

FIG. 5 illustrates a side sectional view taken along line 5—5 in FIG. 2 of a connector 100 with a contact 150 loaded therein. The contact 150 is loaded through an opening 105 in the rear end 104 of the body portion 102. The contact 150 is pressed forward into the pocket 130 until wings 160 abut against an intermediate wall 170 formed on the interior of each pocket 130. The wall 170 extends downward from the bottom surface 138 of the top wall 128 of the shroud 120. The intermediate wall 170 extends across a width of the pockets 130 and is spaced a predetermined distance from the front face 132 to properly locate the contact surface 164 of the contact 150 within the pocket 130.

During contact loading, the hook portion 162 on the contact 150 is slid forward under the intermediate wall 170 until latching with a spring 172 that holds the contact 150 in place. The spring 172 has a rear end 174 fixed to a recessed area within the body portion 102 of the connector 100, for example by heat staking. Once the rear end 174 of the spring 172 is secured in place, an outer end 176 is biased upward into the pocket 130 toward the front face 132. When the contact 150 is loaded, the hook portion 162 snaps over the outer end 176 of the spring 172. Optionally, a notched portion 166 may be punched in the contact 150 to form a ledge that engages the outer end 176 of the spring 172 to prevent the contact 150 from being inadvertently pulled rearward out of the pocket 130.

Optionally, the contact may be formed with a split or forked main body (not shown) to form a pair of hook portions separated by a gap. The gap would receive a rib formed on the top surface of the socket tongue and extending upward through the contact. The rib would also extend forward beyond the contact surface to prevent foreign objects from touching the contact.

Figure 6:
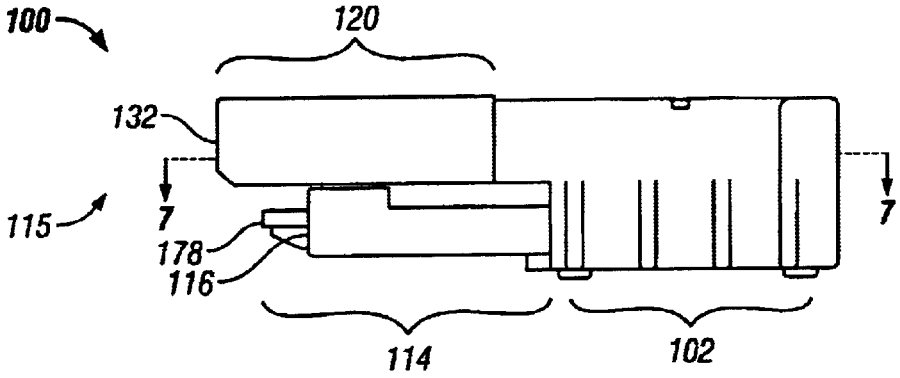
FIG. 6 illustrates a side view of a connector formed in accordance with an embodiment of the present invention.

FIG. 6 illustrates a side view of the connector 100 to further explain the relation between the shroud 120 and the socket tongue 114. The shroud 120 extends forward from the body portion 102 of the connector 100 by a distance greater than the length of the socket tongue 114 to form a staggered or stepped profile for the socket 115. The staggered profile locates the front face 132 on the shroud 120 beyond the lead end 116 on the socket tongue 114. Staggering the front face 132 of the shroud 120 with respect to the socket tongue 114 in the manner illustrated in FIG. 6, in combination with the ribs 136 in FIG. 2, prevents foreign objects from being easily inserted into the pockets 130. Optionally, the front face 132 need not be staggered with respect to the lead end 116 depending upon the size and length of the contacts 150.

The socket tongue 114 also includes tapered pins 178 extending forwardly from the lead end 116. Each tapered pin 178 is received within a corresponding hole 180 (FIG. 5) formed in the intermediate wall 170 in the pocket 130. The taper pins 178 in conjunction with the staggered profile of the shroud 120 increase the clearance to the contact 150 from the exterior of the connector 100.

Figure 7:
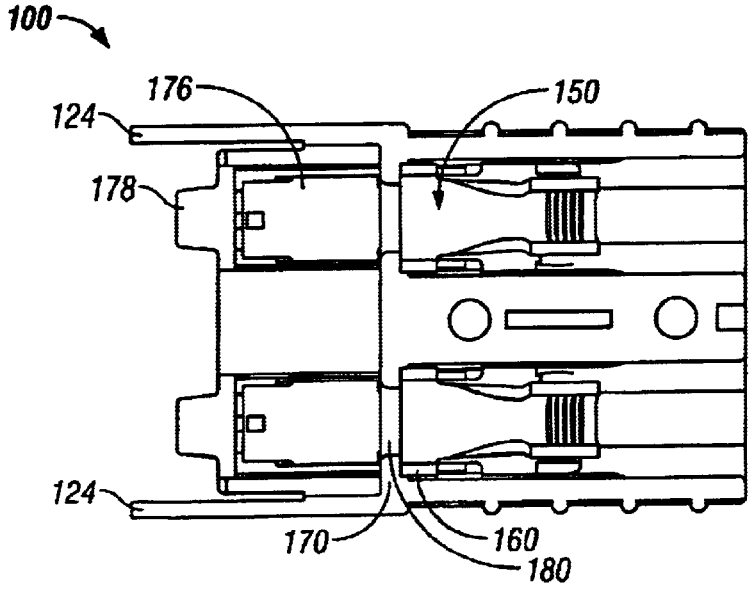
FIG. 7 illustrates a top sectional view of the connector of FIG. 6 taken along line 7—7 in FIG. 6.

FIG. 7 illustrates a top sectional view of a connector 100 taken along line 7—7 in FIG. 6. In the exemplary embodiment of FIG. 7, the contacts 150 are loaded. FIG. 7 better illustrates the tapered pins 178 to extend beyond the outer ends 176 on the contacts 150. Also, the contacts 150 need not only convey power, but instead may represent signal contacts carrying data or ground contacts. FIG. 7 also better illustrates the abutting relation afforded between wings 160 and the intermediate wall 170 to properly locate the contacts 150 within the connector 100 along the length of the pockets 130. The holes 180 through intermediate walls 170 are also shown in FIG. 7 and are aligned to receive corresponding tapered pins 178 on a mating connector 100.

Figure 8:
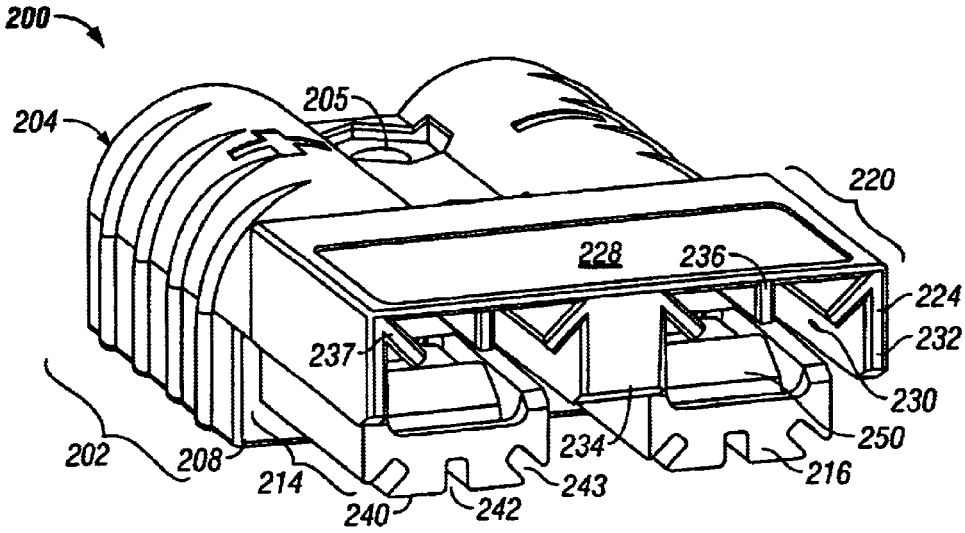
FIG. 8 illustrates a top isometric view of a connector formed in accordance with an alternative embodiment of the present invention.

FIG. 8 illustrates a connector 200 formed in accordance with an alternative embodiment of the present invention. The connector 200 includes a body portion 202 having a rear end 204 to receive cables. A hole 205 is provided through the body portion 202 to receive a bolt and nut to secure the connector 200 to a board or chassis structure. The body portion 202 includes a front end 208 having a socket tongue 214 extending therefrom, along with a socket 220. The socket 220 includes a front face 232, while the socket tongue 214 includes a lead end 216. The socket 220 includes a top wall 228 and side walls 224 that cooperate with the socket tongue 214 to define pockets 230. Each pocket 230 includes diagonal ribs 237 extending into the corresponding pocket 230 from a corner at the point of intersection between the top wall 228 and side wall 224. Diagonal ribs 237 also extend inward into corresponding pockets 230 from the intersection of the top wall 228 and the central partition wall 234. Central ribs 236 are also provided and extend downward from the top wall 228 into the pockets 230. Optionally, ribs may be provided on the interior surfaces of the side walls 224 and/or on the interior surfaces of the central partition wall 234 and directed to extend into the pockets 230.

The bottom surface 240 of the tongue 214 includes cut away portions including a central groove 242 and diagonal grooves 243 configured to align with the central and diagonal ribs 236 and 237, respectively, when corresponding connectors 200 are joined.

Optionally, the connector 100, 200 may be a right angle connector with the shroud 120, 220 and socket tongue 114, 214 directed in a direction oriented at a right angle to the rear end 104, 204 receiving the cable. In a right angle configuration, the body portion 102, 202 and contact 150, 250 would be bent at a right angle. Optionally, the configurations of ribs 136, 236, 237 and grooves 142, 242, 243 may be reversed such that the interior surfaces of one or more sides of the pockets 130, 230 may include grooves 142, 242, 243 and the bottom of the socket tongues 114, 214 may include ribs 136, 236, 237.

Figure 9:
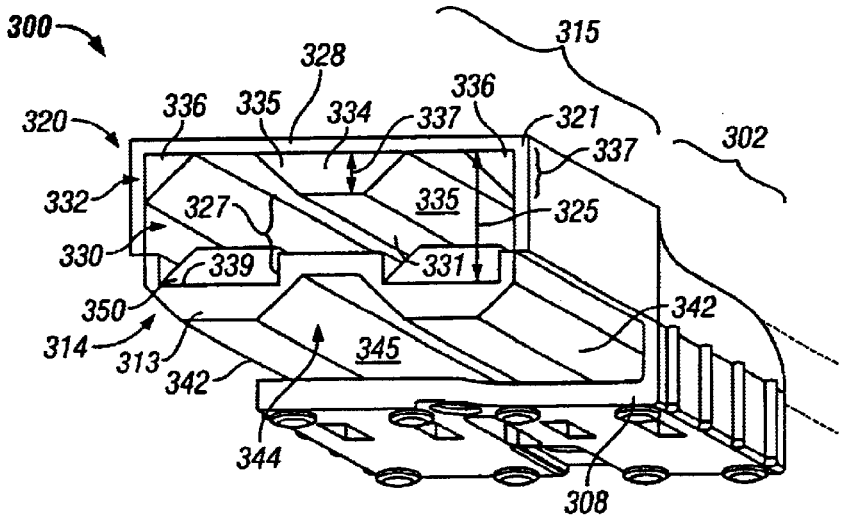
FIG. 9 illustrates an isometric view of a connector formed in accordance with an alternative embodiment.

FIG. 9 illustrates a connector 300 formed in accordance with an alternative embodiment. The connector 300 includes a body portion 302 and a socket 315 formed on a front end 308 of the body portion 302. The socket 315 includes a shroud 320 and a socket tongue 314 formed integral with one another. The socket tongue 314 retains contacts 350. The socket tongue 314 and shroud 320 are formed in a non-staggered relation such that a front edge 321 of the shroud 320 and a front edge 313 of the socket tongue 314 are formed coplanar with one another. The socket 315 includes a pocket 330 opening onto the front face 332.

Beveled corner inserts 336 are formed in opposite corners of the shroud 320 where sidewalls 324 join the top wall 328. The beveled corner inserts 336 fill in a portion of the pocket 330 to reduce the size of the opening at the front face 332. The socket tongue 314 is formed with chamfered edges 342 to remove portions of the socket tongue 314. When the connector 300 is mated with a similarly shaped connector, beveled corner inserts 336 slide along the chamfered edges 342 of the mating connectors 300.

In addition, and optionally, a central partition wall 334 may be provided with beveled sides 335 flared outward from one another also to fill in a portion of the pocket 330. A central channel 344 is formed with chamfered edges 345 to receive the beveled sides 335 of the central partition wall 334.

The pocket 330 has a height 325 from the bottom surface of the top wall 328 to the top surface 339 of the socket tongue 314. The central partition wall 334, as well as the beveled sides 335 and corner inserts 336, have a height 337. The height 327 of the unobstructed portion of the pocket 330 from the top surface 339 of the socket tongue 314 to the bottom surface 331 of the partition wall 334 is reduced by a desired amount in order to prevent finger and/or probe access.

The ribs 136 and 236, beveled sides 335 and corner inserts 336 prevent insertion into the pockets 130, 230 and 330 of foreign objects of a predetermined shape.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A hermaphroditic connector, comprising:

a body portion having a rear end configured to receive a cable;

a socket extending from said body portion away from said rear end, said socket including a pocket, said pocket having an open front face configured to mate with another hermaphroditic connector of similar shape, said socket including a blocking member located within said pocket partially closing said front face of said pocket to prevent insertion into said pocket of foreign objects of a predetermined minimum size, said blocking member having an interior rib extending from said front face into said pocket; and a contact held in said pocket, said contact having a rear end configured to attach to a cable and an opposite lead end configured to engage a mating contact.

2. The connector of claim 1, wherein said rib extending from a top wall of said pocket downward toward said contact to prevent insertion of foreign objects, said rib having a height that is at least approximately one-quarter of a height of said pocket.

3. The connector of claim 1, said rib being received in a groove formed in an exterior wall of said socket on another hermaphroditic connector of similar shape.

4. The connector of claim 1, wherein said socket includes a socket tongue having a bottom side facing away from said pocket, said bottom side having a groove therein configured to receive said rib in a pocket of a mating connector of similar shape.

5. The connector of claim 1, wherein said blocking member projects into said pocket by a distance that is at least approximately one-quarter of a height of said pocket.

6. The connector of claim 1, wherein said socket includes a shroud and socket tongue, said shroud having a length that is greater than a length of said socket tongue to form a staggered arrangement in said front face.

7. The connector of claim 1, wherein said socket includes a socket tongue having a pin extending from said front face.

8. The connector of claim 1, wherein said pocket extends between said front face and said rear end and includes an intermediate wall partially projecting into, and oriented transverse to, a length of said pocket, said contact having a wing extending outward to abut against said intermediate wall to locate an outer end of said contact at a predefined depth from said front face within said pocket.

9. The connector of claim 1, further comprising a spring having one end secured to said body portion, said spring projecting along said pocket toward said front face, said spring retaining said contact within said pocket.

10. The connector of claim 1, wherein said blocking member is located in said pocket and extends between said open front face and said lead end of said contact.

11. The connector of claim 1, wherein said pocket has an overall interior envelope formed by interior surfaces of said socket, said blocking member extending into and reducing said overall interior envelope of said pocket.

12. A hermaphroditic power connector, comprising:

a housing having a rear end configured to receive a power cable with a contact secured thereto, said contact being secured in said housing; and a socket formed on said housing and projecting beyond a front end of said housing, said socket and housing having a pocket extending therethrough that opens onto a front face of said socket and onto said rear end of said housing, said socket including a blocking member located within said pocket and partially closing said pocket proximate said front face to prevent insertion into said pocket of foreign objects having a predetermined minimum size, said socket having an exterior surface including a cut-away portion to accept said blocking member on a mating connector of similar shape.

13. The connector of claim 12, wherein a top interior surface of said pocket includes ribs defining said blocking member that project toward said contact and a bottom exterior surface of said socket includes grooves as said cutaway portion, said ribs and grooves being configured to receive corresponding grooves and ribs on an inverted mating connector of similar shape.

14. The connector of claim 12, wherein said blocking member extends from said socket into said pocket by a distance that is approximately one-quarter to one-third of a height of said pocket.

15. The connector of claim 12, wherein said socket further comprises a shroud and socket tongue forming a staggered profile with respect to one another.

16. The connector of claim 12, wherein said blocking member extends from said socket into said pocket by a distance sufficient to obstruct approximately 25 percent of said opening of said pocket onto said front face.

17. The connector of claim 12, wherein said socket includes a top wall, side walls and a socket tongue that defines an interior envelope of said pocket, said blocking member having a rib projecting into said interior envelope to prevent foreign objects from being inserted into said pocket.

18. The connector of claim 12, wherein said blocking member includes at least one of ribs and beveled corner portions formed in said pocket and extending an interior envelope of said pocket.

19. The connector of claim 12, further comprising a spring having one end secured to said housing, said spring projecting along said pocket toward said front face, said spring retaining said contact within said pocket.

20. The connector of claim 12, wherein said socket comprises a tongue portion with at least one of grooves and chamfered edges cut therein, as said cut-away portion, to receive said blocking member on a mating connector of similar shape.

21. The connector of claim 12, wherein a top side of said pocket includes an intermediate wall extending across a width of said pocket, said intermediate wall having a hole therethrough, said socket having a pin extending from a lead end thereof, said pin being configured to fit into said intermediate hole in a mating connector of similar shape.

22. The connector of claim 12, wherein said blocking member is located in said pocket and extends between said front face and a lead end of said contact.

23. The connector of claim 12, wherein said pocket has an overall interior envelope formed by interior surfaces of said socket, said blocking member extending into and reducing said overall interior envelope of said pocket.

* * * * *